US005370204A

United States Patent [19]

Fox

[11] Patent Number: 5,370,204

[45] Date of Patent: Dec. 6, 1994

[54] COLLAPSIBLE LADDER FOR AUTOMOTIVE PAINTING

[76] Inventor: Steven N. Fox, 2318 E. 110th St., Kansas City, Mo. 64131

[21] Appl. No.: 222,173

[22] Filed: Apr. 4, 1994

Related U.S. Application Data

[63] Continuation of Ser. No. 977,120, Nov. 16, 1992, abandoned.

[51] Int. Cl.[5] ..... B25H 5/00

[52] U.S. Cl. ..... 182/156; 182/116; 182/152; 182/180; 182/127

[58] Field of Search ..... 182/115, 116, 127, 152, 182/156, 165, 180, 93, 17

[56] References Cited

U.S. PATENT DOCUMENTS

| | | | |
|---|---|---|---|
| 28,039 | 4/1860 | Kavemann | 182/209 X |
| 141,126 | 7/1873 | Eagon | 182/180 |
| 292,932 | 2/1884 | Markwick | 182/156 X |
| 1,185,515 | 5/1916 | McCrystle . | |
| 1,381,397 | 6/1921 | Briles | 182/180 |
| 1,812,119 | 6/1931 | Reese | 182/180 |
| 2,605,037 | 7/1952 | Smith | 182/180 |
| 2,634,037 | 4/1953 | Bortel | 182/180 |
| 3,730,295 | 5/1973 | Deese | 182/163 |
| 4,072,209 | 2/1978 | Bolis . | |
| 4,520,896 | 6/1985 | Disston et al. | 182/156 X |
| 4,618,029 | 10/1986 | Lowry | 182/116 |
| 4,727,958 | 3/1988 | Botello . | |
| 4,754,843 | 7/1988 | Anderson | 182/129 |
| 4,863,178 | 9/1989 | Friesen . | |
| 4,867,273 | 9/1989 | Schaevitz . | |

*Primary Examiner*—Alvin C. Chin-Shue
*Attorney, Agent, or Firm*—Hovey, Williams, Timmons & Collins

[57] ABSTRACT

A collapsible ladder assembly (10) is provided which is particularly adapted for use in and around automobiles in order to provide convenient access to the upper portions of the vehicle for painting or other purposes. The ladder assembly (10) includes a generally horizontally extending base (12) preferably including a pair of spaced apart rails (18, 20), together with a ladder (14) operably coupled to the base (12). The ladder (14) is preferably oriented in an upright position and at an angle of at least 60° relative to the platform (12), and an essentially vertically oriented strut assembly (16) is employed for stabilization purposes. In use, the base assembly (12) can be positioned beneath an automobile (66) with the upright ladder (14) closely adjacent a side panel (68) of the automobile (66). The assembly (14) can also be folded together to assume a compact storage configuration.

3 Claims, 1 Drawing Sheet

COLLAPSIBLE LADDER FOR AUTOMOTIVE PAINTING

This application is a file wrapper of application Ser. No. 07/977,120, filed Nov. 16, 1992, abandoned.

BACKGROUND OF THE INVENTION

1. Field of the Invention

The present invention is broadly concerned with an improved ladder assembly which is particularly adapted for use in automobile body and repair shops in order to facilitate access to and around an automobile body as during painting operations. More particularly, the invention pertains to a ladder assembly including a relatively low, elongated platform configured to fit beneath an automobile body between the wheels thereof, with an upright ladder secured to the platform adjacent the outer end thereof at an angle which permits placement of the ladder closely adjacent the side panel of the automobile. In preferred forms, the ladder includes essentially vertical stabilizing struts interconnecting the ladder and platform, with the entire ladder assembly being collapsible to assume a compact, folded-up storage position.

2. Description of the Prior Art

During the repair or cleanup of automobiles, and particularly during body work such as painting, it often arises that workers need easy, safe access to the upper part or interior spaces of the automobile body. By way of example, when painting an automobile body, it is often very difficult to conveniently paint the roof panel, owing to the fact that no convenient platform or other means is provided giving the painter proper access. Furthermore, automotive detail and clean-up workers find it difficult to reach the roof top for buffing and waxing. This difficulty can be particularly pronounced in the case of taller vehicles such as trucks and vans. In attempting to work on hard to reach areas such as the upper or interior body regions, workers may cause damage to other portions of the automotive body, for example, as occurs when cleanup and detail workers, or even bodymen, stand upon the doorsills for support.

Conventional A-frame ladders are of limited utility in this context, because of the fact that the forward legs of the ladder opposite the rungs interfere with placement of the ladder closely adjacent the automobile body. By the same token, locating such a ladder astride an automobile is no answer, because this forces the worker to work in an unnatural and even unsafe position. It has also been known in the past to employ scaffolding in a paint booth. This expedient is expensive, takes up valuable shop space, and is deficient in that the scaffolding completely lacks portability and operational flexibility. Furthermore, the scaffolding that is employed typically lacks a bar to lean against or over, which leads to unsafe conditions and presents difficulty to workers.

There is accordingly a decided need in the art for an improved ladder assembly especially adapted for use in and around automobiles which permits easy, safe and convenient access to all areas of the automobile while providing a stable work platform.

SUMMARY OF THE INVENTION

The present invention overcomes the problems outlined above and provides a ladder assembly particularly suited for facilitating access to and around an automobile body. The ladder assembly broadly includes a generally horizontally extending, ground-engaging platform presenting an inner end and an opposed outer end together with a ladder having a pair of spaced apart, upright standards with horizontal rungs extending therebetween; means is provided for coupling the lower end of the ladder to the platform adjacent the outer end thereof with the ladder being in an upright orientation and at an angle of at least about 60° relative to the platform. The platform is configured for fitting beneath an automobile body between a pair of wheels so that the upright ladder lies closely adjacent a side panel of the automobile. Furthermore, the upper end of the ladder is located above the platform and between the inner and outer ends thereof.

In preferred forms, a pair of laterally spaced apart struts are provided which extend in an upright fashion and interconnect the platform and ladder for stabilizing the entire assembly. Moreover, the angle of the upright ladder relative to the platform is advantageously greater than about 70° and most preferably about 77°. In order to provide the most comfortable work station, a padded, horizontally extending cross piece support is located adjacent the upper end of the ladder and extends between the standards.

The ladder assembly also preferably includes structure pivotally securing the ladder standards to the platform in order to permit selective pivoting of the ladder to a position adjacent the platform, whereby the entire assembly assumes a compact, folded-up storage position. In addition, the stabilizing struts are pivotally connected to the ladder and are releasably connected to the platform, so that the struts may be folded between the platform and ladder in the storage position.

DETAILED DESCRIPTION OF THE PREFERRED EMBODIMENTS

Figures 1, 2, 3, 4:
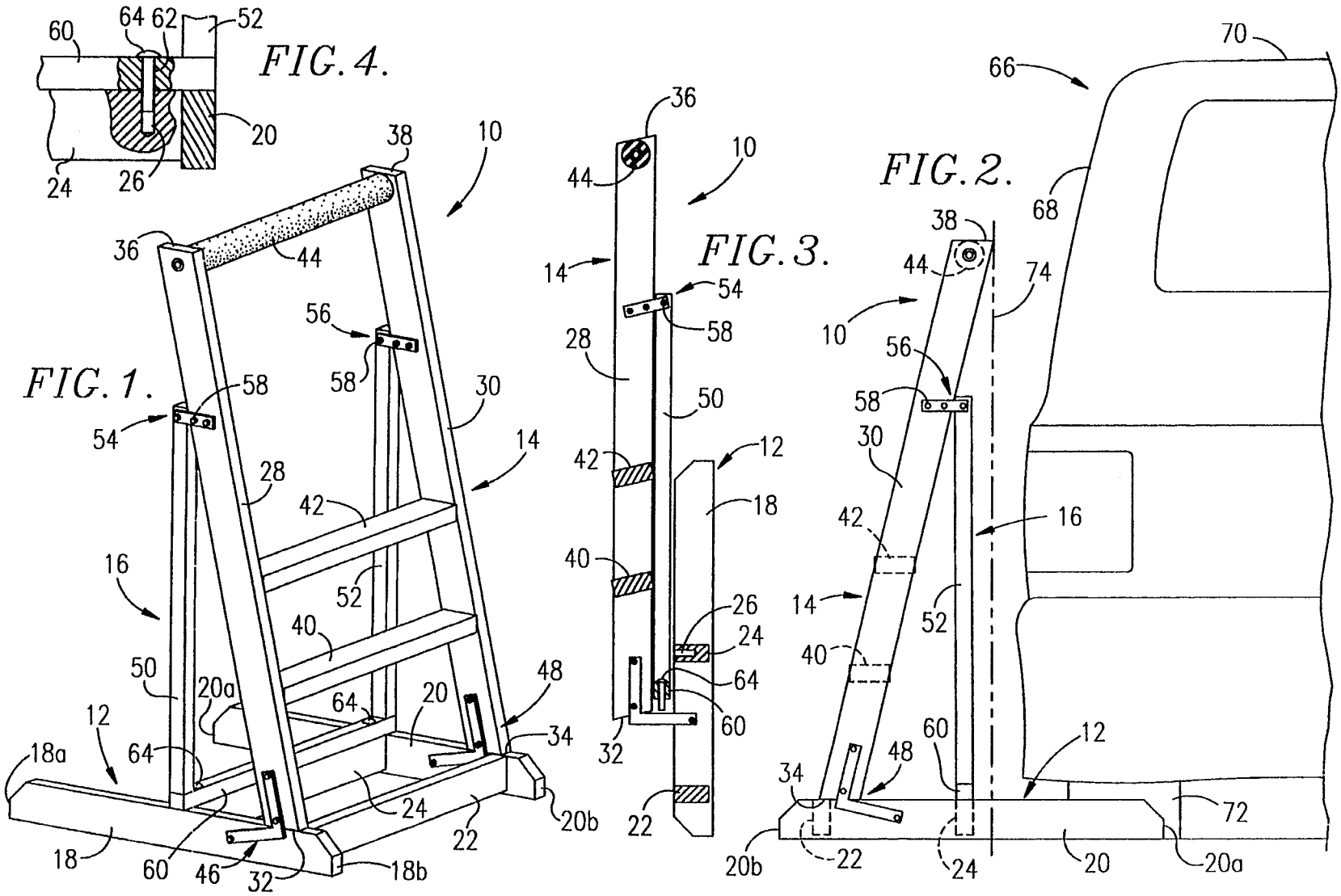
FIG. 1 is a perspective view of a ladder assembly in accordance with the invention, illustrated in its upright use position.
FIG. 2. is a side view of the ladder assembly, shown in operative disposition adjacent an automobile.
FIG. 3 is a vertical sectional view of the ladder assembly with the ladder in its compact, folded-up storage position.
FIG. 4 is an enlarged, fragmentary view in partial vertical section illustrating the releasable pin connection between the upright reinforcing struts and the underlying ladder assembly platform.

Turning now to the drawings, and particularly FIG. 1, a ladder assembly 10 is depicted. Broadly speaking, assembly 10 includes an horizontally extending, ground-engaging base 12, as well as an upright, obliquely oriented ladder 14 and a substantially vertically oriented, generally U-shaped strut assembly 16. In more detail, base 12 is in the form of a pair of elongated, laterally spaced apart rails 18, 20 presenting corresponding inner ends 18*a*, 20*a* and outer ends 18*b*, 20*b*. A pair of transverse interconnecting beams 22, 24 are also provided, the latter having a pair of spaced apart pin-receiving apertures 26 therein (see FIG. 3).

Ladder 14 includes a pair of laterally spaced apart standards 28, 30 presenting obliquely cut, lowermost butt ends 32 and 34, as well as opposed upper ends 36, 38. A pair of vertically spaced apart rungs 40, 42 span the distance between the standards 28, 30, and are connected thereto. A transversely extending, padded, cylindrical cross piece 44 is provided adjacent the upper standard ends 36, 38 as shown.

The ladder 14 is pivotally connected to base 12 by means of two cooperating pairs of metallic L-brackets 46 and 48; a pair of L-brackets is affixed to the opposed faces of each standard 28, 30 adjacent the lower butt ends thereof, with the generally horizontally extending legs of the brackets being pivoted to a corresponding rail 18 or 20. As best seen in FIG. 1, the standards 28, 30 are connected to the base rails 18, 20, so that, in the upright position of the ladder 14, the butt ends 32, 34 of the standards come into flush contact with the upper faces of the underlying rails.

The strut assembly 16 includes a pair of generally vertically oriented strut members 50, 52 respectively pivotally coupled to a corresponding ladder standard between upper rung 42 and cross piece 44. This pivotal connection is provided by means of two pairs of metallic straps 54, 56, as well as appropriate threaded connectors 58. The lower ends of the strut members 50, 52 are interconnected by means of beam 60, the latter having a pair of apertures 62 therethrough oriented for alignment with the beam apertures 26. In the upright use position of the ladder assembly 10, the strut assembly 16 is substantially vertically oriented, with beam 60 disposed atop the rails 18, 20, as well as beam 24. In this orientation, elongated connector pins 64 are passed through the mating apertures 62 and 26 in order to releasably lock the strut assembly 16 in place, thereby providing proper stabilization for the overall ladder assembly.

The use of assembly 10 is best illustrated in FIG. 2, in the context of work in and around an automobile 66. The latter includes side panels 68 and top panel 70, and is supported by wheels 72. In this connection, it will be observed that the base 12 is of sufficiently low profile to pass beneath the automobile body and either between a pair of wheels 72, or in straddling relationship to a single wheel. Accordingly, the ladder 14 can be positioned in close adjacency to the corresponding automobile side panel 68 so that a worker can ascend the ladder and comfortably work in and around top panel 70. Of course, provision of the padded cross piece 44 serves to support the worker who may lean against piece 44 in this position on the ladder.

As indicated previously, the orientation of ladder 14 relative to the generally horizontal base 12 should be at an angle of at least about 60°, and more preferably at least 70°. Furthermore, the upper ends 36, 38 of the standards 28, 30 should lie above the base 12 and between the inner and outer ends **18*a*, 20*a* and 18*b*, 20*b* thereof. It will furthermore be observed that the ladder assembly 10 is completely free of obstructions inwardly of a vertical plane 74 passing through the inner edge of the standards 28, 30 and above base 12; this insures that the assembly can be placed in sufficient proximity to an automobile for ready access thereto. Furthermore, the horizontal length of the base 12 inwardly of plane 74 (i.e., in a direction toward the rail ends 18*a*, 20*a***) should be at least 50% of the horizontal length of the base outwardly from the plane.

When use of the ladder assembly is finished, it is only necessary to withdraw the assembly from beneath the automobile 66 and fold the ladder to its storage position depicted in FIG. 3. This involves removing the pins 64 from the apertures 62, 26, whereupon the strut assembly 16 may be pivoted to a position adjacent the ladder 14, and these members may then be pivoted to a position close to the base 12. In this configuration, the assembly 10 is very compact and can be readily moved and handled.

The ladder assembly 12 can be conveniently fabricated from wood with appropriate metal connectors and pins; alternately, the ladder assembly could be constructed of a light-weight metal such as aluminum, plastic, or fiberglass.

It should be understood that the description hereinabove is for that of the most preferred embodiment, and other embodiments exist within the spirit of the invention. For example, FIG. 1 presents a pair of rungs, 40 and 42, but the number of rungs may vary in accord with the intended environment of use. That is, a painter may prefer three rungs in order to better access the roof area, but a detail worker may prefer a single rung in order to better access the interior seat regions of the automobile.

I claim:

1. A ladder apparatus for facilitating access to and around an automobile body presenting upright side panels, a top panel, and a plurality of spaced wheels that support the body above the ground, the apparatus comprising:

a ground-engaging platform including a pair of laterally spaced apart, generally parallel ground-engaging rails presenting an inner end adapted to extend beneath the automobile body and an opposed outer end, and a pair of transverse beams interconnecting the rails, the beams being spaced from the inner end of the platform by a distance greater than half the distance between the inner and outer ends so that the apparatus can be placed in straddling relation to one of the wheels in sufficient proximity to the automobile body to facilitate access to the automobile;

a ladder including a pair of laterally spaced apart, generally parallel standards presenting an upper end and a lower end, and a pair of horizontal rungs connected between the standards and being spaced from one another;

a coupling means for coupling the ladder to the platform for pivotal movement between a storage position in which the ladder is spaced from the platform and the standards are oriented substantially parallel to the rails of the platform, and a use position in which the standards are angled upward toward the inner end of the platform at an angle of at least 60° relative to the rails;

a strut assembly including a pair of laterally spaced apart, generally parallel struts presenting an upper end and a lower end, and a cross beam interconnecting the struts at the lower end; and a connection means for connecting the strut assembly to the ladder for pivotal movement between a storage position in which the struts are oriented parallel to the standards of the ladder, and a use position in which the struts are oriented at an angle to the standards, the strut assembly being accommodated between the ladder and the platform when the ladder and strut assembly are in the storage position, and stabilizing the ladder on the platform when the ladder and strut assembly are in the use position.

2. A ladder apparatus as recited in claim 1, wherein the standards are oriented at an angle of at least 70° relative to the rails when the ladder is in the use position.

3. A ladder apparatus as recited in claim 1, wherein the standards are oriented at an angle of approximately 77° relative to the rails when the ladder is in the use position.

* * * * *